United States Patent [19]

Fujiwara

[11] Patent Number: 4,686,004

[45] Date of Patent: Aug. 11, 1987

[54] TWIN-WIRE FORMER FOR PAPERMAKING MACHINE

[75] Inventor: Haruyoshi Fujiwara, Mihara, Japan

[73] Assignee: Mitsubishi Jukogyo Kabushiki Kaisha, Tokyo, Japan

[21] Appl. No.: 906,654

[22] Filed: Sep. 21, 1986

Related U.S. Application Data

[63] Continuation of Ser. No. 683,198, Dec. 18, 1984, abandoned.

[30] Foreign Application Priority Data

Dec. 30, 1983 [JP] Japan ..... 58-246717

[51] Int. Cl.[4] ..... D21F 1/36; D21F 1/40

[52] U.S. Cl. ..... 162/300; 162/301; 162/303

[58] Field of Search ..... 162/300, 301, 303, 348

[56] References Cited

U.S. PATENT DOCUMENTS

| | | | |
|---|---|---|---|
| 4,220,502 | 9/1980 | Levanen | 162/301 |
| 4,414,061 | 11/1983 | Trufitt et al. | 162/303 |
| 4,417,950 | 11/1983 | Bubik et al. | 162/300 |
| 4,447,295 | 5/1984 | Bubik et al. | 162/300 |
| 4,459,175 | 7/1984 | Bubik et al. | 162/300 |
| 4,523,978 | 6/1985 | Pullinen | 162/301 |

FOREIGN PATENT DOCUMENTS 1336713 11/1973 United Kingdom .

OTHER PUBLICATIONS

Pulp and Paper, 1984, "Top Flyte Former" advertisement.

*Primary Examiner*—S. Leon Bashore
*Assistant Examiner*—K. M. Hastings
*Attorney, Agent, or Firm*—Wenderoth, Lind & Ponack

[57] ABSTRACT

A twin-wire former for a paper machine which can produce paper of good formation over a wide range of basis weight and at a speed of wide variation essentially consisting of a top wire and a bottom wire. The bottom wire with a wet material thereon substantially horizontally travels. The top wire approaches the material from above and travels downward together with the bottom wire on the circumference of a supporting member provided in the loop of the bottom wire while pressing the material between the pair of wires. At the position of a force roll provided in the loop of the top wire, the pair of wires commence travelling upwardly through a suction box to a couch roll, where the pair of wires separate from each other. To adjust the wire contacting angle of the supporting member, and hence, to improve the formation of paper, each of a water receiver, the force roll and suction boxes and made movable.

3 Claims, 4 Drawing Figures

TWIN-WIRE FORMER FOR PAPERMAKING MACHINE

This application is a continuation of now abandoned application Ser. No. 683,198, filed Dec. 18, 1984.

BACKGROUND OF THE INVENTION

This invention relates to a twin-wire former for a papermaking machine which produces a fiber mat by dewatering a (fiber suspension) material by sandwiching the material between two wire screens (hereinafter "wire screen" is represented as "wire"). This invention particularly relates to improvements in a twin-wire former of the type in which a material is ejected out into a bottom wire which travels substantially horizontally; water is removed out of the material downwardly by means of the foils or the like arranged beneath the wire; and thereafter a top wire which is arranged to sandwich the material by approaching the bottom wire from above and travel downwardly along with the bottom wire on the circumference of a roll provided within the loop of the bottom wire and water is removed upwardly above the top wire.

In the conventional twin-wire former, where the material is sandwiched between two wires, the circumference angle of contact between the wires and the roll, (hereinafter "the wire contacting angle") is fixed. This conventional twin-wire former has a drawback in that formation is deteriorated when the condition of the material to be sandwiched between the wires, for example, thickness or consistency of the material deviates out of a certain range. In addition, in production of thick paper, which needs a large quantity of material to be sandwiched, part of the material is often disadvantageously rejected (toward the upstream side) out of the portion where the two wires come into contact and, travelling in the same direction, press the wet material (hereinunder the portion is represented as "wedge portion"), particularly when the speed of the paper machine is low.

On the other hand, with paper produced by what is called a Fourdrinier machine which forms a fiber mat by removing the water only downwardly with a single wire which travels horizontally, the paper surface facing the wire has fewer fines and less clay, because the fines and clay in the vicinity thereof are washed out. When twin wires are formed by providing another wire (top unit) over the Fourdrinier so as to remove the water upwardly also, it is possible to make the distribution of the fines and the clay in the thickness of the paper more uniform on both sides.

However, the conventional twin-wire former of this type cannot produce paper with good formation over a wide range of basis weight and running speed.

SUMMARY OF THE INVENTION

Accordingly, it is an object of the invention to solve this problem and to obtain a twin-wire former for a paper machine which can produce paper with good formation over a wide range of basis weight, from thin to thick, and at a machine running speed in a wide range, from low to high.

When a pair of wires, namely a top wire and a bottom wire, travel downward on the circumference of a roll for removing the water upwardly through the top wire with a material sandwiched between the wires, as the wire contacting angle on the circumference of the roll is increased, those portions which contain more fiber tend to move to the portions having fewer fibers, which improves the overall formation. However, a wire contacting angle which is too large moves fibers excessively toward the nipping point (in the direction opposite to the traveling direction of the wires), which deteriorates the formation of the paper.

Therefore, it is another object of this invention to improve the formation of paper by adjusting the wire contacting angle within the range in which the formation of paper is not deteriorated.

To adjust the wire contacting angle of the roll, in a twin-wire former according to this invention, a water receiver for receiving the water drawn off to the top wire side, a roll, and suction boxes are made movable.

The above and other objects, features and advantages of the present invention will become clear from the following description of the preferred embodiments thereof, taken in conjunction with the accompanying drawings.

DESCRIPTION OF THE PREFERRED EMBODIMENTS

Figure 1:
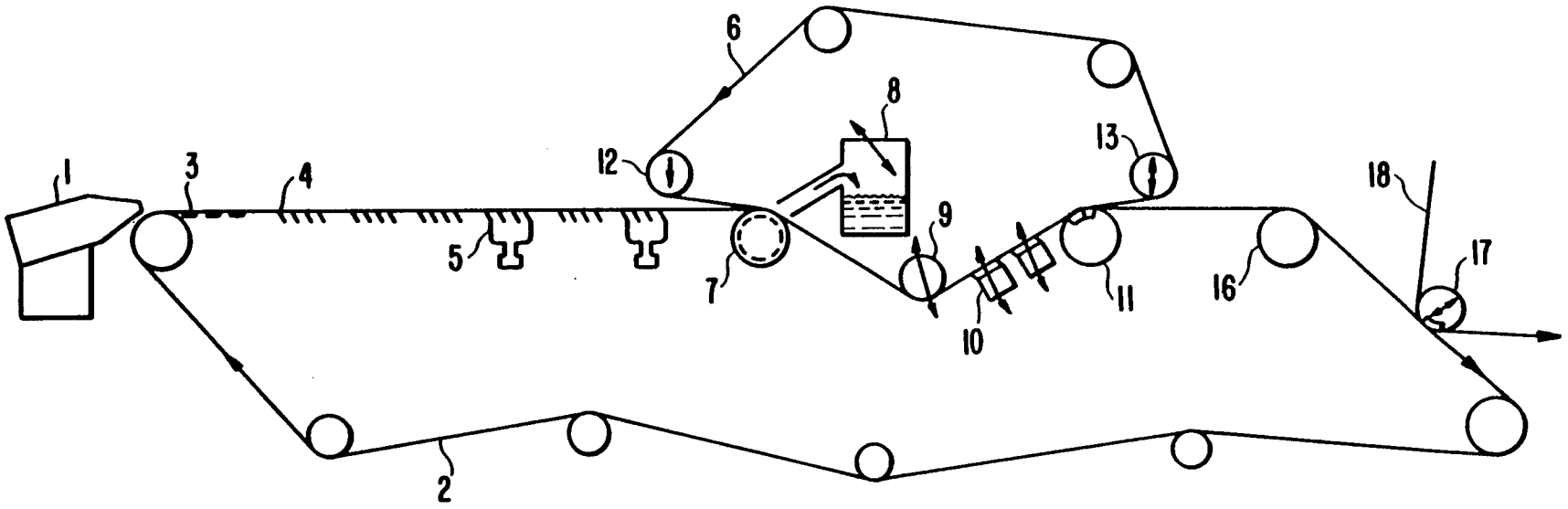
FIG. 1 is a side sectional view of a first embodiment of a twin-wire former according to the invention.

Referring first to FIG. 1, a material is ejected out of the opening portion of a head box 1 onto a bottom wire 2 travelling substantially horizontally. Within the loop of the bottom wire 2, forming boards 3 and foils 4 are arranged. Vacuum foil boxes 5 for dewatering with a vacuum pressure and by means of the foils 4 are arranged at desired portions. A top wire 6 approaches the material from above to sandwich it between the top wire 6 and bottom wire 2. The run of the pair of wires (twin wires) is directed downwardly around the circumference of a roll 7 which is placed within the loop of the bottom wire 2. Thus the water is drawn off to the top wire side and received by a water receiver 8 which is movable.

A roll 9, which is movable towards or away from the twin-wires, is provided so as to control the wire contacting angle of the roll 7, and similarly movable suction boxes 10 for dewatering by means of vacuum pressure are also provided. Thereafter a couch roll 11 is disposed so that the two wires 2, 6 travel around the circumference of the couch roll 11. A fiber mat is attracted toward the bottom wire 2 by the vacuum pressure of the couch roll 11, and the top wire 6 is released upwardly.

The bottom wire 2 travels substantially horizontally after passing around the couch roll 11 and is directed obliquely downwardly by a wire roll 16. When the bottom wire 2 comes into contact with a felt 18 which is guided by a suction pick-up roll 17 on this slanted portion, the sheet of paper is transferred to the felt 17, whereby it is fed to the next stage. The surfaces of the rolls 7, 9 used for dewatering may be solid, or an open roll made by cutting a groove on the surface thereof and covering a wire of rough meshes may also be used. The roll 7 shown in FIG. 1 is not movable towards and away from the upper or lower wires and is an open roll. The roll 9 may be replaced by a suction roll.

The position of rolls 12, 13 can be adjusted by adjustment mechanisms not shown in the Figure. The rolls 12, 13 control the nipping point of the material where the wet material begins to be sandwiched between the twin wires 2, 6 and the separation point where the top wire 6 is separated from the fiber mat, respectively. The water receiver 8 receives the water drawn off from the wires by virtue of the vacuum pressure. It is preferable to make the water receiver movable towards and away from the twin wires and rotatable around the axis of rotation of the roll 7, as is indicated by the arrow in FIG. 1.

Figure 2:
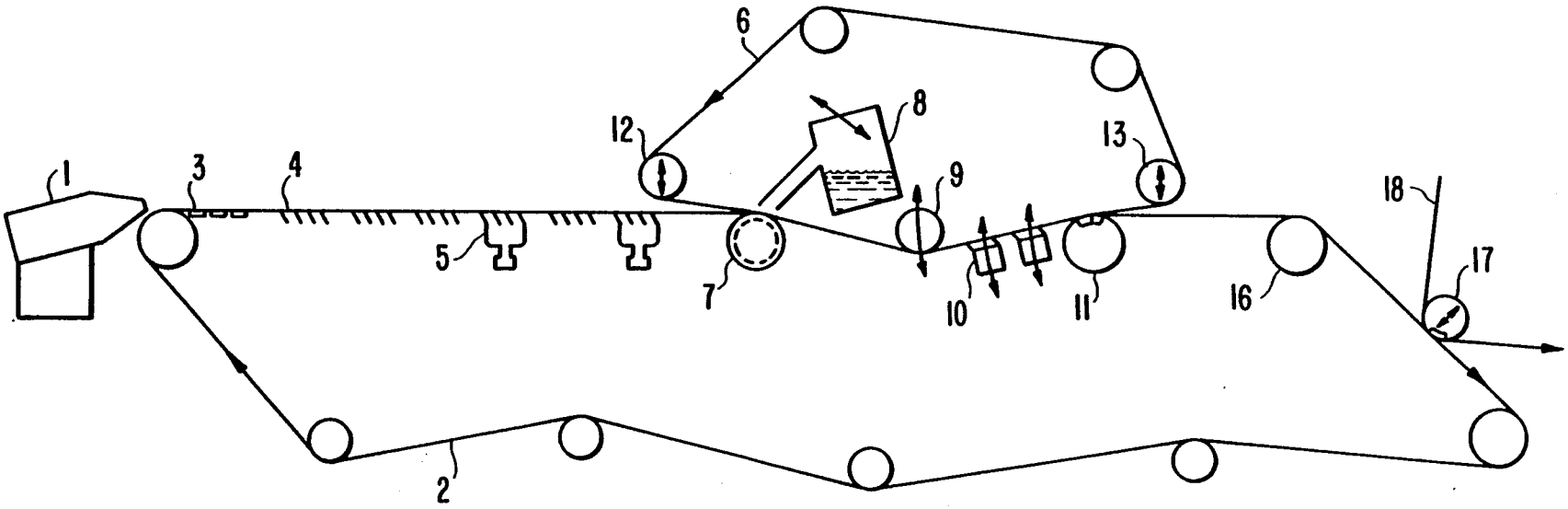
FIG. 2 is a side sectional view of the first embodiment of a twin-wire former according to the invention in which the operation state is different from the one in FIG. 1.

Further, the roll 9 and the suction boxes 10 are also preferably mounted on support means which allows the roll 9 and suction boxes 10 to be movable and rotatable around the axis of rotation of the roll 11, as is indicated by the arrow in Figure 1. The suction boxes 10 which are disposed within the loop of the bottom wire 2 may be disposed in the loop of the top wire 6. In FIG. 2, the roll 9 in FIG. 1 is moved upward along a circular path centered on the axis of rotation of the couch roll 11 and the amount of the wire contacting angle is reduced.

The operation will be explained in the following. The material coming out of the head box 1 is dewatered on the bottom wire 2 in the same way as in the conventional Fourdrinier dewatering section. The amount of drainage and the phenomenon of material jumping on the wire vary depending on the angle of the foils, as is known. Therefore the formation of paper is adjusted by altering a combination and arrangement of a plurality of foils with different angles depending on a type of paper and the operation speed of a paper machine.

In the Fourdrinier machine, since the upper surface of the material is free, the dewatering pressure applied to the material before and after it passes the foils is not high. The retention of fines in the dewatering section of the Fourdrinier is high compared with a former in which the material is sandwiched between the two wires immediately after coming from the head box and is dewatered by members called "shoes" which are similar to the foils.

The angle of a foil and vacuum pressure of the vacuum foil box 5 are adjusted so that the thickness and the consistency of the material may be appropriate for the successive process where the material is sandwiched between the twin wires. Since the material which is sandwiched between the twin wires is first dewatered upwardly on the circumference of the roll 7, the amount of drainage on the upper side is large, which leads to little difference in distribution of fines and clay between the surface facing the bottom wire side and the surface facing the top wire.

As the roll 9 in the twin-wire portion is moved downwardly, the wire contacting angle of the roll 7 becomes large, and thus the amount of drainage also becomes larger. At this time the portion of the material containing more fibers moves to the portion having fewer fibers as it is pressed between the twin wires. This improves the formation.

However, a wire contacting angle which is too large moves fibers in the material sandwiched between the wires in the direction opposite to the traveling direction of the wires up to the upstream side of the wedge portion, which deteriorates the formation of the paper. Therefore, the formation is improved by adjusting the wire contacting angle within the range in which the formation is not deteriorated. Since the dewatering pressure does not fluctuate in the dewatering conducted by the roll 7, unlike the dewatering conducted by rubbing the wires with foils and shoes, the retention of fines is high. The suction box 10 removes further water by vacuum pressure.

The top wire 6 is separated from the bottom wire 2 on the couch roll 11. At this time, the fiber mat is pulled toward the bottom wire 2 by vacuum pressure, which prevents the fiber mat from travelling together with the top wire 6. Generally, in the case of making paper of large basis weight, a smaller degree of pushing down the wire by the roll 9 and accordingly a smaller wire contacting angle than in the case of paper of small basis weight is required to prevent the material sandwiched between the twin-wires from moving in the opposite direction up towards the upstream side of the wedge portion, and hence, the deterioration of the formation.

Figure 3:
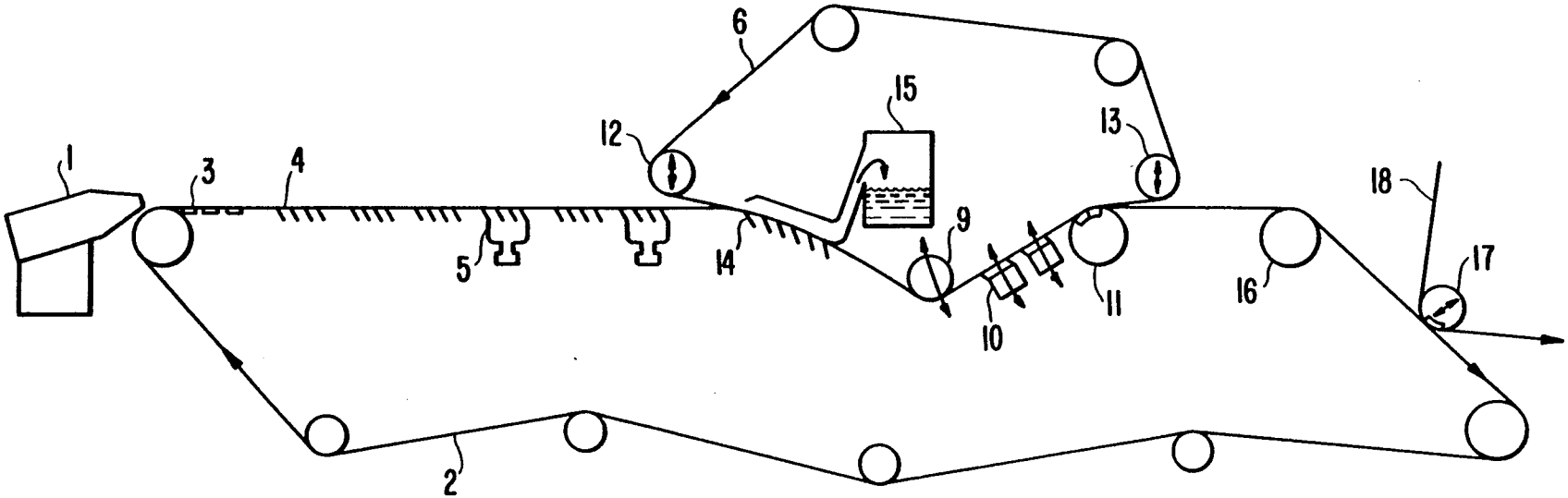
FIGS. 3 and 4 are side sectional views of second and third embodiments, respectively, of the invention.

FIG. 3 shows another embodiment of the invention. In place of the roll 7 shown in FIG. 1, a plurality of supporting blades 14 are arranged such that the surfaces abutting the wire form an arc. The water removed upwardly from the wires 2, 6 is received by a movable water receiver 15. The supporting blades 14 may be in the form of shoes which are used in the known Belbaie former.

The operation with respect to the embodiment shown in FIG. 3 will be described in the following. The further downward the roll 9 is moved, the more often the two wires touch the edges of the supporting blades, whereby the amount of drainage can be increased. At this time the portion of the material containing more fibers moves to the portion having fewer fibers as it is sandwiched between the twin wires. This improves the formation of paper.

However, if the wire contacting angle of the supporting blades 14 which are arranged in an arc-like configuration is too large, the material between the wires moves in the opposite direction up towards the upstream side of the wedge portion. This deteriorates the formation. Therefore, the formation is improved by adjusting the wire contacting angle of the supporting blades 14 of the arc-like arrangement within the range in which the formation is not deteriorated.

When the material between the two wires passes the plurality of supporting blades, the fluctuating dewatering pressure is applied to the material on the edges of the blades a number of times. This dewatering pressure moves the fibers in the material in the micro scale such that the portion with more fibers move to the portion with fewer fibers, thus improving the formation of paper.

In the case shown in FIG. 3, the retention of the fibers with the supporting blades 14 is decreased as compared with the case of applying the roll 7 shown in FIG. 1, but paper with good formation and with less difference in fines distribution between the upper and reverse surfaces can be produced in a wide range of basis weight and a wide range of speed.

Figure 4:
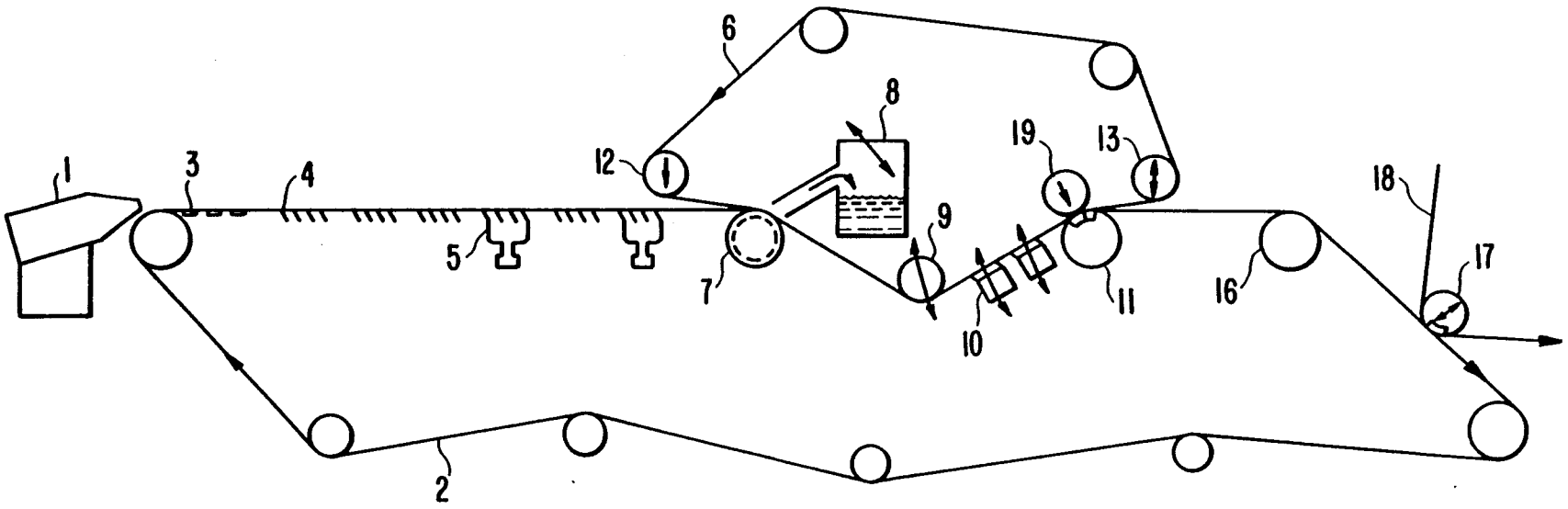

In FIG. 4 a fourth embodiment of the invention is illustrated. This embodiment is different from the one shown in FIG. 1 in that a roll 19 is disposed within the loop of the top wire 6 such that the two wires 2, 6 are pressed against the suction zone on the circumference of the couch roll 11. The surface of the roll 19 is preferably covered with soft rubber.

The operation with respect to the embodiment shown in FIG. 4 will now be explained. The fibers between the top wire 6 and the bottom wire 2 are pressed by the pressing force of the roll 19 when they pass between the roll 19 and the couch roll 11. At this time the portion of the material with more fibers moves to the portion with fewer fibers as it is sandwiched between the twin wires. This improves the formation of the fiber mat. The removed water is sucked by the vacuum zone of the couch roll.

As water is removed from the wet material between the two wires, the consistency of the fibers becomes high, and the fibers move with more difficulty. But in the embodiment shown in FIG. 4, it is possible to move the fibers by pressing the fibers strongly between the two wires with the pressing force of the roll 19 within the range in which the formation of paper is not deteriorated. Accordingly, the formation of paper is improved even more.

As has been described above in detail, according to the the present invention, paper with good formation and showing less difference in fines distribution between the top and bottom surfaces can be produced in a wide range of basis weight and speed.

While there have been described what are at present considered to be preferred embodiments of the invention, it will be understood that various modifications may be made therein, and it is intended that the appended claims cover all such modifications as fall within the true spirit and scope of the invention.

What is claimed is:

1. A twin-wire former for a papermaking machine comprising:

a bottom wire arranged to travel in a loop, said bottom wire supported by means dividing a top run into four successive, continguous portions in the traveling direction of said bottom wire, said portions comprising a horizontal portion where said bottom wire is adjacent to a head box which ejects a wet material onto said bottom wire as said bottom wire travels horizontally past said head box, a downwardly inclined portion, an upwardly inclined portion and a final portion;

supporting member means provided under said top run of said bottom wire, said supporting member means being located at a position where said horizontal portion of said bottom wire joins said downwardly inclined portion of said bottom wire;

a top wire arranged to travel in a loop, said top wire being supported by top wire support means, said top wire support means disposed above said bottom wire and causing said top wire to approach said bottom wire at a position above said supporting member means, said top wire support means causing said top wire to travel together with said bottom wire in said downwardly inclined portion and said upwardly inclined portion to thereby sandwich material between said top wire and said bottom wire as said top wire and said bottom wire travel together in said downwardly inclined portion and said upwardly inclined portion;

water receiver means movably positioned above said upper wire in said downwardly inclined portion, said water receiver means causing water to be removed from material sandwiched between said upper wire and said lower wire;

movable roll means, positioned above said upper wire and said lower wire at a position where said downwardly inclined portion joins said upwardly inclined portion, and being movable towards and away from said top and bottom wires for adjusting the contact angle between said supporting member means and said upper and lower wires;

suction box means, movable towards and away from said top and bottom wires, positioned along said upwardly inclined portion; and couch roll means provided under said top run of said bottom wire, said couch roll means located at a position where said upwardly inclined portion joins said final portion, said couch roll means positioned relative to said top wire support means for causing said upper wire to separate from said lower wire as said upper and lower wires pass by said couch roll means, said couch roll means comprising a couch roll having an axis of rotation and said movable roll means being mounted on support means for rotating said movable roll means about said axis of rotation of said couch roll, and said movable roll means supported by said support means is movable towards and away from said upper wire and said lower wire along a circular path centered on said axis of rotation of said couch roll.

2. The twin-wire former of claim 1, wherein said couch roll means includes a suction zone and said top wire support means further includes a movable roll disposed to press said top and bottom wires against said suction zone of said couch roll means.

3. The twin-wire former of claim 1, wherein said supporting member means is a dewatering roll which is not movable towards or away from the upper and lower wires and said movable roll means is a suction roll.

* * * * *